US008607809B2

(12) United States Patent
Jordan et al.

(10) Patent No.: US 8,607,809 B2
(45) Date of Patent: Dec. 17, 2013

(54) INDEPENDENTLY ADJUSTING, MULTI-LEGGED WALKING CANE

(75) Inventors: James D. Jordan, Grapevine, TX (US); Randy G. Misenheimer, Euless, TX (US); Shyh Min Chen, Plano, TX (US)

(73) Assignee: Ranjam, LLC, Grapevine, TX (US)

( * ) Notice: Subject to any disclaimer, the term of this patent is extended or adjusted under 35 U.S.C. 154(b) by 314 days.

(21) Appl. No.: 12/723,224

(22) Filed: Mar. 12, 2010

(65) Prior Publication Data

US 2011/0220161 A1 Sep. 15, 2011

Related U.S. Application Data

(60) Provisional application No. 61/215,390, filed on May 5, 2009.

(51) Int. Cl.
*A45B 9/04* (2006.01)
*A61H 3/02* (2006.01)

(52) U.S. Cl.
USPC ..... 135/82; 135/66; 135/78; 135/84; 248/188.8; 248/616

(58) Field of Classification Search
USPC ..... 135/65–66, 68, 70, 77–78, 82, 84, 85; 248/188.1, 188.7–188.9, 615, 616
See application file for complete search history.

(56) References Cited

U.S. PATENT DOCUMENTS

| | | | | | |
|---|---|---|---|---|---|
| 2,888,022 | A * | 5/1959 | Fanning | 135/82 |
| 3,289,685 | A * | 12/1966 | McCall Parker | 135/65 |
| 4,091,828 | A * | 5/1978 | Jorgensen | 135/66 |
| 4,932,719 | A * | 6/1990 | Gonzalez | 297/338 |
| 4,984,761 | A * | 1/1991 | Chen | 248/188.7 |
| 5,238,013 | A * | 8/1993 | Battiston et al. | 135/75 |
| 5,331,990 | A * | 7/1994 | Hall et al. | 135/65 |
| 5,390,687 | A * | 2/1995 | Tsai | 135/65 |
| 5,794,638 | A * | 8/1998 | Richey et al. | 135/65 |
| 5,806,548 | A * | 9/1998 | Goldstein et al. | 135/65 |
| 6,055,998 | A * | 5/2000 | Bader | 135/69 |
| 7,509,966 | B2 * | 3/2009 | Karasin et al. | 135/66 |
| 7,647,937 | B2 * | 1/2010 | Gordon | 135/65 |
| 2007/0175503 | A1 * | 8/2007 | Gordon | 135/65 |

FOREIGN PATENT DOCUMENTS

| | | | | |
|---|---|---|---|---|
| FR | 2625899 | A2 * | 7/1989 | A45B 1/00 |
| JP | 10151163 | A * | 6/1998 | A61H 3/02 |
| JP | 2000325119 | A * | 11/2000 | A45B 9/04 |
| JP | 2002065328 | A * | 3/2002 | A45B 9/04 |
| JP | 2003339802 | A * | 12/2003 | A61H 3/02 |
| JP | 2006110346 | A * | 4/2006 | |
| JP | 2007020756 | A * | 2/2007 | |
| JP | 2007136122 | A * | 6/2007 | |
| JP | 2009233041 | A * | 10/2009 | |

* cited by examiner

*Primary Examiner* — Winnie Yip
(74) *Attorney, Agent, or Firm* — Klemchuk Kubasta LLP

(57) ABSTRACT

The invention is a multi-legged walking cane where each leg operates independently of each other by employing compressible legs, enhancing stability thru the complete gait cycle.

10 Claims, 4 Drawing Sheets

INDEPENDENTLY ADJUSTING, MULTI-LEGGED WALKING CANE

CROSS-REFERENCE TO RELATED APPLICATIONS

Prov. App. 61/215,390, filed May 5, 2009, to which this application claims priority.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE OF THE MATERIAL ON THE COMPACT DISC

Not Applicable

BACKGROUND OF THE INVENTION (1) Field of the Invention

The present invention pertains to canes used by those who need assistance in maintaining stability while walking.

(2) Description of the Related Art Including Information Disclosed Under 37 CFR 1.97 and 1.98.

Walking canes are well known to those with ordinary skill in the art. Walking canes from prior art include the ancient walking cane consisting of a single stick held in one hand and providing stability when the user places the distal end on the ground in the direction of travel so that the stick provides a third point of contact with the ground as the user moves. Modern walking canes can be more complex, with three or four legs on a foot assembly (U.S. Pat. No. 4,044,784), allow for an adjustment of staff length (U.S. Pat. No. 4,085,763), or telescoping canes for easy storage when not in use (U.S. Pat. No. 3,987,807).

Newer multiple-leg canes attempt to provide superior stabilization by providing more than one point of contact with the ground. With two or more contacts, the cane is less likely to twist or turn than when a single point of contact is maintained. However, the success of these canes is limited because the points of contact must change during the gait.

For example, a four-legged cane usually has only two of its legs in contact with the ground for most of a user's gait; the back two legs of a four-legged cane touch the ground when the user extends it out to take a step. As the user's center of gravity reaches the cane's contact points, all four legs are on the ground, and then as the user passes the contact points and before the user pulls up the cane and places it forward again, only the front two legs of the cane remain in contact with the ground. This creates a multiple-stage use of the cane that is less graceful than the use of a standard one-legged cane.

Another challenge for multiple-legged canes comes when the ground upon which the user is walking is uneven. If a user is walking on unimproved dirt or rock, a multi-leg cane may have only two or three legs touching the ground. Under such circumstances the user can be surprised by the lack of contact of one leg that creates in an unexpected lack of support and result with the user falling.

What is needed is a multi-legged cane that can, a) maintain multiple points of contact during the entirety of the user's gait, and b) easily self-adjust to changing ground surfaces.

BRIEF SUMMARY OF THE INVENTION

The general object of the multi-legged cane is to offer those needing assistance to walk with a cane that provide the increased stability of a multi-legged cane with the ability to adjust to rough ground, as well as to provide a graceful motion of the cane throughout a user's gate. The invention uses independently adjustable and tensioned legs on the cane to gain these advantages.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations pointed out in the appended claims.

BRIEF DESCRIPTION OF THE SEVERAL VIEWS OF THE DRAWING

The attached drawings are provided as non-limiting examples of the invention.

DETAILED DESCRIPTION OF THE INVENTION

Figure 1:
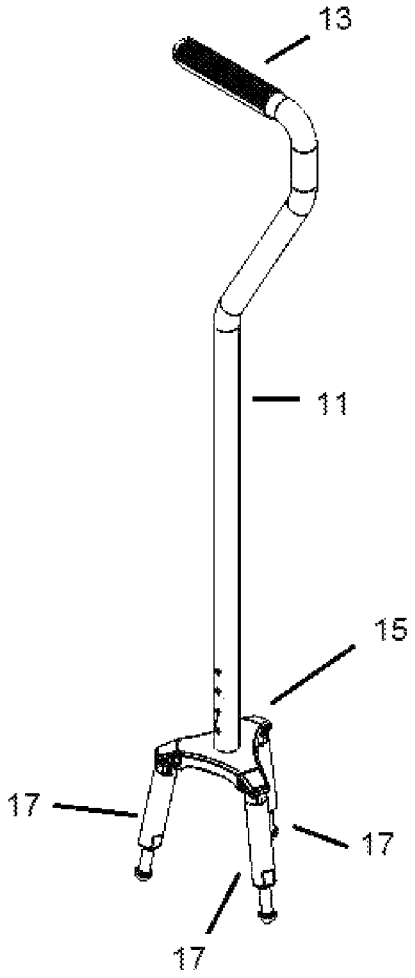
FIG. 1—Orthogonal view of the cane.
Figure 4:
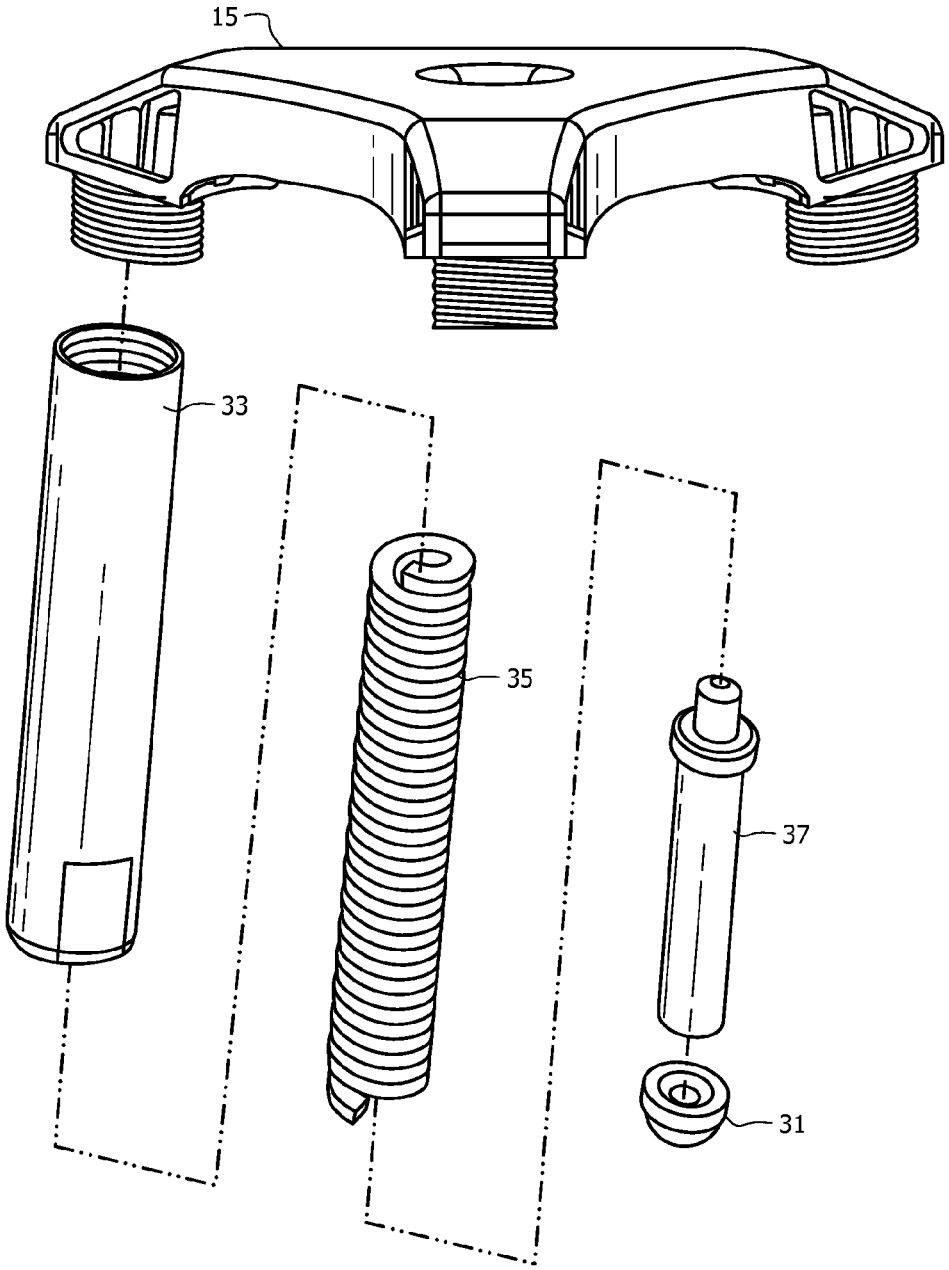
FIG. 4—Exploded view of a cane according to an embodiment of the present disclosure.

According to the present invention, the foregoing and other objects and advantages are attained by a cane as in FIG. 1, comprising a shaft 11, said shaft with upper end with handle element 13, lower end with base 15 holding multiple legs 17, each with an independently operating spring system (such as spring or tension element 35 depicted in FIG. 4).

Figure 2A:
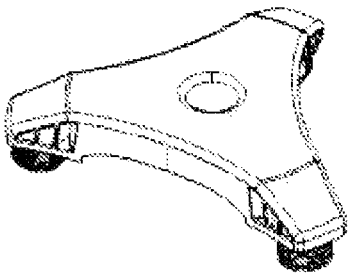
FIG. 2—Orthogonal view of three and four-legged leg base.
Figure 2B:
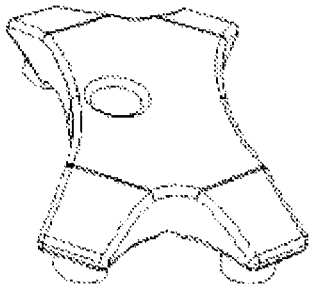
Figure 3:
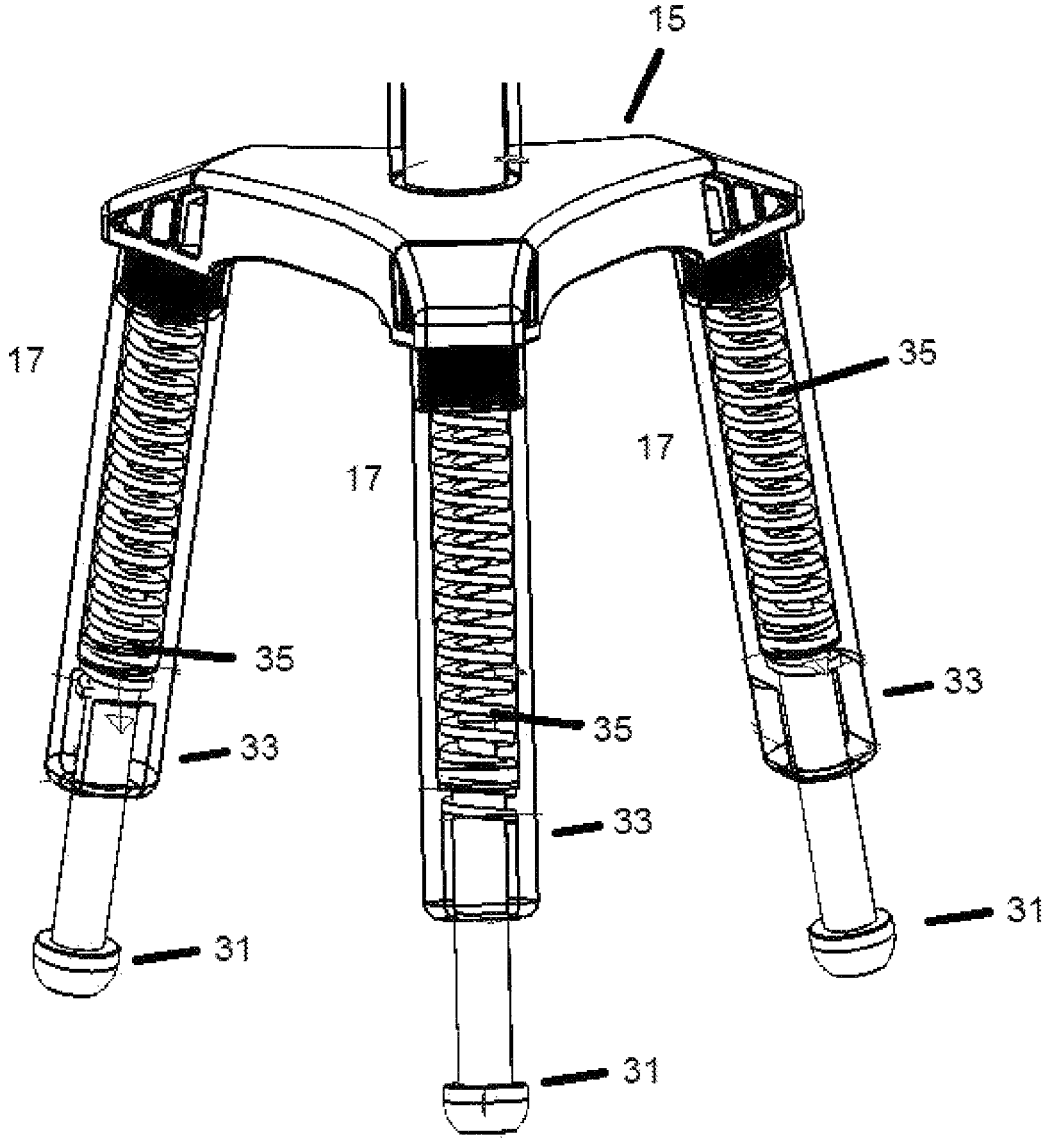
FIG. 3—Orthogonal partial view of cane's base.

The base 15 can be fixed to the cane's lower end by threads, screws or other means. Different bases can be interchanged onto the cane to allow for different numbers of legs, typically two to four on a base. FIG. 2 shows bases for two- and three-legged bases.

As shown in FIG. 4, each leg 17 consists of a tube section 33, a spring or tension element 35, and a foot 31 to provide solid contact with the walking surface. The flange slides into the slots of the primary shaft 13. In the preferred embodiment, each leg 17 contains a spring positioned between the plunger 37 at its lower end, and an end stop at its upper end. The position of the spring's end stop is adjustable by use of detents in each leg (not shown), allowing for each user of the cane to adjust for his preferences and needs. Positive constant contact of all legs is attained by allowing each leg to adjust to variations in position of each foot/leg relative to the angle of the cane, the ground surface, including surface variations, and the position of the user. As downward pressure is applied to the cane, the foot on the end of each leg compresses a spring allowing the foot to stay in constant contact with the ground, regardless of the angle of the cane, while each leg maintains the same up and down travel distance capability. Spring tension can be adjusted to compensate for size of users via the detents in the foot housing, and/or with interchange of springs.

In the preferred embodiment, the cane has three legs, but other embodiments could have fewer or more. In all cases, the cane's user would place his weight on the cane, and the cane would respond by allowing some compression in cane legs equipped with compression elements such that the user's weight is distributed on the several legs, irrespective of uneven ground.

The cane can be configured many different ways, including the use of a rigid center leg, but with the other legs compressible. In unusual cases, one or more of the other legs would be rigid, with others compressible, depending on a user's rehabilitative needs.

As the user walks, the cane's angle with the ground changes. The legs will decompress and compress as the user walks, just as he would with a single-legged cane, but with the added assistance of the other legs' contact with the ground, the cane is less likely to twist or slip.

The invention claimed is:

1. A walking cane comprising:

a shaft having an upper end and a lower end, the lower end having a plurality of legs affixed to a base, each of the legs including a tube section, an independently operating spring system including an interchangeable spring being inserted within the tube section, a plunger affixed to the independently operating spring system, and a foot affixed to the lower end of the plunger, wherein upon application of downward pressure to the independently operating spring system from the plunger to the foot, the independently operating spring system compresses and the foot of each leg maintains constant contact with the ground with the same travel distance capability maintained in each leg.

2. The walking cane of claim 1 wherein the upper end of the shaft comprises a handle element.

3. The walking cane of claim 1 wherein the base is affixed to the lower end of the shaft via fastening mechanisms.

4. The walking cane of claim 3, wherein the fastening mechanisms are threads.

5. The walking cane of claim 3, wherein the fastening mechanisms are screws.

6. The walking cane of claim 1 wherein the lower end of the shaft is slotted and threaded and each of the plurality of legs slides into a slot and is held in place with a locking cap that screws into the lower end.

7. The walking cane of claim 1 further comprising:

a middle leg that does not compress.

8. A walking cane comprising:

a shaft having a near end and a distal end;

an interchangeable base coupled to the distal end; and a plurality of independently adjustable and tensioned legs affixed to the interchangeable base, wherein each of the plurality of independently adjustable and tensioned legs has an interchangeable spring with a plunger disposed within the spring and a foot attached to the plunger, wherein when pressure is applied to the spring, each of the legs moves in a vertical direction and each of the legs maintains the same up and down travel distance capability relative to the ground.

9. The walking cane of claim 8 wherein the position of the foot is adjusted.

10. The walking cane of claim 8 further comprising:

a rigid leg positioned centrally with respect to the plurality of independently adjustable and tensioned legs.

* * * * *

UNITED STATES PATENT AND TRADEMARK OFFICE

CERTIFICATE OF CORRECTION

PATENT NO. : 8,607,809 B2
APPLICATION NO. : 12/723224
DATED : December 17, 2013
INVENTOR(S) : James D. Jordan et al.

It is certified that error appears in the above-identified patent and that said Letters Patent is hereby corrected as shown below:

IN THE SPECIFICATION

Column 2, line 49, "two-" should read -- three- --;

Column 2, line 50, "three-legged" should read -- four-legged --.

Signed and Sealed this
First Day of March, 2016

Michelle K. Lee

Michelle K. Lee
*Director of the United States Patent and Trademark Office*